United States Patent [19]

Coffman et al.

[11] Patent Number: 4,834,389

[45] Date of Patent: May 30, 1989

[54] CROSS COUNTRY BOARD GAME

[76] Inventors: Anthony Coffman, 1064 A N. Broadway, North Massapequa, N.Y. 11758; Steven E. Gender, P.O. Box 364, Highland Mills, N.Y. 10930

[21] Appl. No.: 261,107

[22] Filed: Oct. 24, 1988

[51] Int. Cl.[4] ..... A63F 3/00

[52] U.S. Cl. ..... 273/252

[58] Field of Search ..... 273/252, 251, 254, 246, 273/250, 253

[56] References Cited

U.S. PATENT DOCUMENTS

| | | | |
|---|---|---|---|
| 1,529,908 | 3/1925 | Newcombe | 273/252 |
| 4,049,274 | 9/1977 | Jevons | 273/246 |
| 4,134,591 | 1/1979 | Brooks | 273/252 |
| 4,377,287 | 3/1983 | Erwin | 273/252 |
| 4,643,430 | 2/1987 | D'Aloia | 273/252 |

FOREIGN PATENT DOCUMENTS

| | | | |
|---|---|---|---|
| 184517 | 8/1922 | United Kingdom | 273/251 |
| 1192400 | 5/1970 | United Kingdom | 273/254 |

*Primary Examiner*—Edward M. Coven
*Assistant Examiner*—Benjamin Layno
*Attorney, Agent, or Firm*—Leonard Belkin

[57] ABSTRACT

A board game simulating the competition between motorcyclists travelling across country and required to make stops at several motorcycling events. The board is provided with a principal route on which several home cities are located and several secondary routes, some of which are dead ends, on which are located the events. Each player has a token and starts from a different home city to which he must return to win, the first player returning being the winner. A spinner on the board is utilized to move the playing pieces.

3 Claims, 2 Drawing Sheets

DOWN AND OUT

PUMPED GAS FOR THE DAY EARNED $ 50

GET OUT OF JAIL

YOU STOPPED TO HELP SOMEONE IN A BROKEN DOWN CAR

THEY TIPPED YOU $ 20

MOVE AHEAD 3 SPACES

YOU FIND $ 10 ON THE ROAD

TOO DRUNK TO RIDE

LOSE ONE TURN

BUSTED

GO TO JAIL

YOUR BIKE BROKE DOWN

LOSE A TURN

BLOWN ENGINE

PAY 10 X SPINNER FOR REPAIRS

TICKET FOR LOUD EXHAUST $ 50

CROSS COUNTRY BOARD GAME

BACKGROUND OF THE INVENTION

This invention relates to a board game and more particularly to a board game designed to simulate the activities of motorcyclists, hereinafter referred to as bikers, travelling throughout the continental United States.

There are a variety of board games available designed to represent different types of activities. Typical of such games are shown in U.S. Pat. Nos.: 1,555,363, 1,574,394, 4,109,917, 4,134,591, 4,426,084 and 4,629,195. There is no teaching or suggestion of the present invention in the aforementioned patents.

SUMMARY OF THE PRESENT INVENTION

An object of the present invention is to simulate in a board game the activities of two or more bikers competing in a route across the continental United States to attend certain "meets", that is, motorcycling events, and to return to their home bases with the winner being the biker, or player, who completes the course first.

In a preferred embodiment of the invention, the competing bikers meet up with the types of problems, obstacles, and challenges typical of that which bikers are likely to encounter during an actual cross country tour thereby making the game truer to life and more exciting than previous board games involving the use of vehicles. All players follow the same route but start at different locations, stop at the same meets, and return to their starting points, or home cities.

It is believed that the present game will be found especially appealing to bikers as well as those who aspire to engage in biking activities.

Other objects and advantages of this invention will become obvious from the following detailed description of a preferred embodiment of this invention.

DETAILED DESCRIPTION OF THE PREFERRED EMBODIMENT

Figure 1:
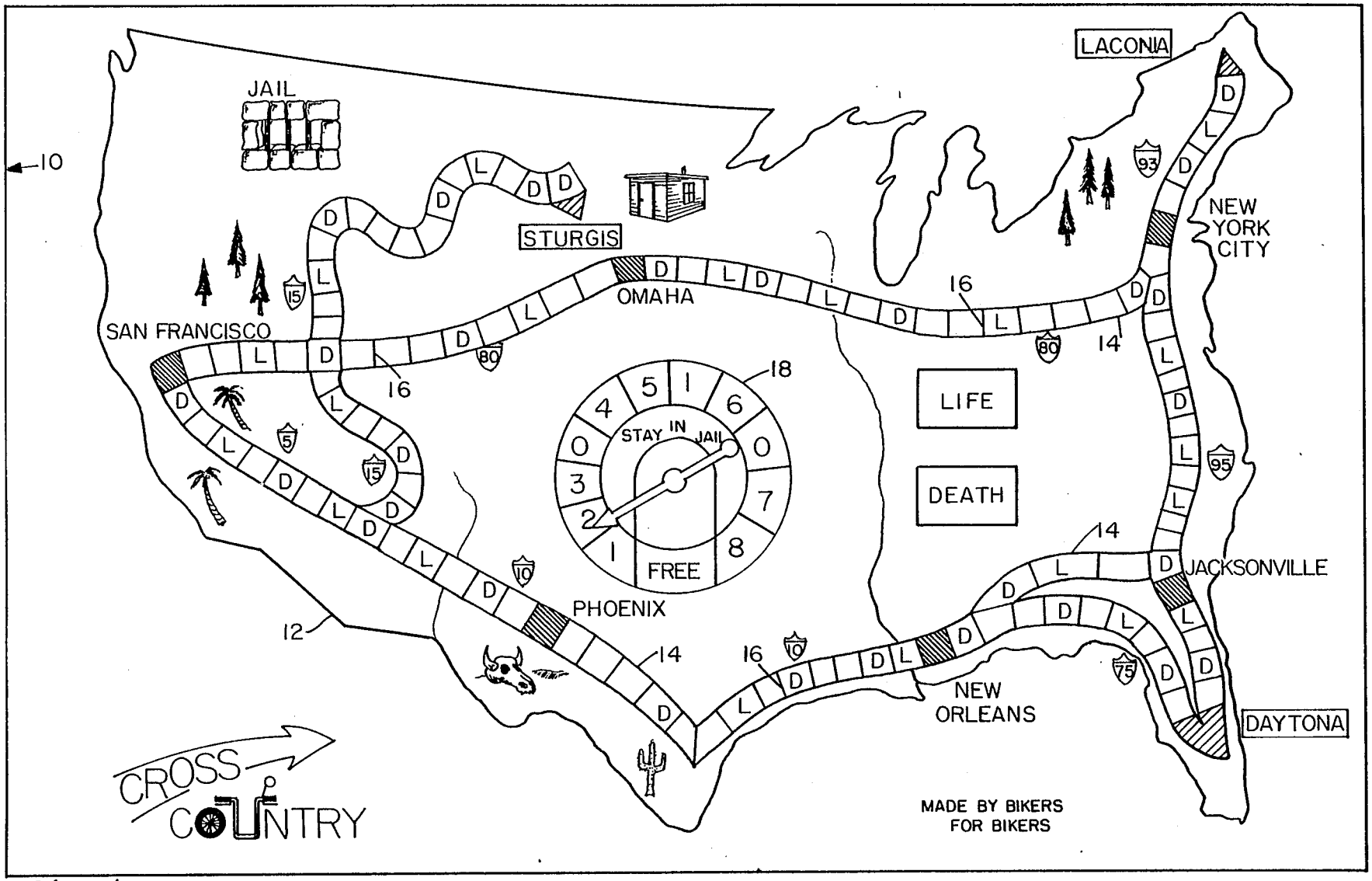
FIG. 1 is a plan view of the game board of this invention illustrating the continental USA with selected routes and stops as well as a spinner and other features which are pertinent to the playing of this game.

Referring to FIG. 1, game board 10 displays the outline 12 of the continental USA with a principal route or course 14 which the bikers (players) will follow during the course of the game. Route 14 is divided into segments or spaces 16 which represent positions for the tokens or pieces used by the players to represent their positions and movement along the course. A spinner 18, also located on board 10, is used by the players in turn to indicate how many places 16 to move their tokens or pieces.

Along route 14 are six cities, namely, New York City, Omaha, San Francisco, New Orleans, Phoenix, and Jacksonville, representing the starting points for the bikers. In addition, there are three motorcycle events or "meets" at Laconia, Sturgis, and Daytona, where the bikers are required to make stops during their travels over the course and to get a card for attending the meet.

It will be noted that the locations of the meets, namely, Laconia, Sturgis and Daytona are on secondary routes including dead ends, some of which are arranged to give the player some choice as to routes to follow.

Before describing in detail the remaining pieces and the rules to be followed in order to play this board game, a general description of the game follows.

Each biker starts in a different one of six cities so that the game as described can accomodate from two to six players. The winner of the game is the first biker who makes all three required stops and gets back to home base (his starting city). A novel aspect of this board game can be seen from board 10 where it will be noted that the stops or "meets" are located so that the biker has some choice, though limited, in a route to be followed. Thus, a certain amount of judgement is required.

Figures 2, 3A, 3B, 3C, 3D, 3E, 4A, 4B, 4C, 4D, 4E:
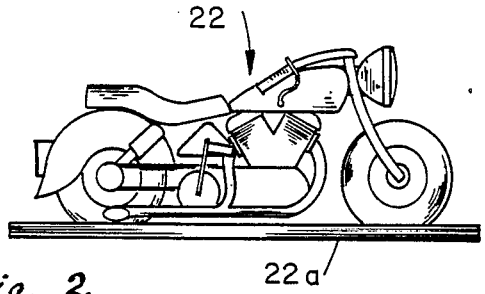
FIG. 2 is an elevation view of a playing piece.
FIGS. 3*a* through 3*e* are views of representative cards in the LIFE deck.
FIGS. 4*a* through 4*e* show representative cards in the DEATH deck.

Each biker is provided with a token or a playing piece in the form of a motorcycle, such as piece 22 shown in FIG. 2, color coded to match the color of its starting city, so that each of the cities on board 10 is in a different color, with base 22*a* for positioning the piece upright.

On board 10 are five stacks of cards, labeled LIFE, DEATH, STURGIS, LACONIA, and DAYTONA. These decks are shown on board 10. When a biker lands on one of the motorcycle events, he takes a card labeled for the event, ie, STURGIS. Thus, to win he must get back to his home city and have one such card from each event.

The decks represented by LIFE and DEATH consist of cards which either aid or set back the biker. Selected spaces 16 on route 14 indicate with an L or a D whether the biker should pick a card from one of those decks. FIGS. 3*a* through 3*e* and FIGS. 4*a*–4*e* show samples of LIFE and DEATH cards, respectively. These cards would be stacked face down so that the biker will not know until he takes a card what instructions he is getting.

Instead of designating the decks LIFE and DEATH, the decks may be identified by different names or by designs or logos. In addition, while not shown, the cards in the two decks may have X-rated instructions to enliven interest in the game.

Following are the official instructions to play this game:

1. 2 to 6 players.
2. Highest spin goes first—then clockwise.
3. Objective—Each player starts at one of the home cities (colored to match motorcycles) and must return to home city after going to all three motorcycle events. (Sturgis, Laconia & Daytona—obtain one card from each)—First one to complete trip is winner.
4. Each player gets $500 to start the game.
5. Player must get exact number to land on his home city or motorcycle event.
6. Only 2 motorcycles allowed on a square.
7. Player must move on each spin—backward or forwards or stay where he is as the spinner directs.
8. Must obey cards and pay fines—if player can't pay fine he must go to jail.
9. To get out of jail player must pay $200 bail or spin to land on get out of jail free. If he does not get out on 3 spins he is pardoned and returned to his home city.
10. If player has all 3 motorcycle event cards and goes to jail, he must go to any city but his own when getting out of jail.

It is thus seen there has been provided a unique board game which simulates the activities of bikers on a trip throughout the continental U.S.A. with stops at a number of motorcycling events.

While only a preferred embodiment of the invention has been described it is understood that many variations are possible without departing from the principles of this invention as defined in the claims which follow.

What is claimed is:

1. A game of competition between players representing motorcyclists comprising:

a. a playing board having defined thereon a map of the continental USA containing a principal route forming a closed loop covering substantially all of the continent and a series of secondary routes some of which interconnect portions of said principal route and some of which branch off and terminate in a dead end some of which form alternate paths of travel;

b. a plurality of home cities located on and distributed along said principal route, each of said cities being the starting and ending points for a player;

c. a plurality of locales for motorcycle events located on said secondary routes including each of those on the end of a branch which terminates in a dead end;

d. each player represented on said board by a playing piece which is color coded to match the color of the city of origin on said board;

e. all of said routes broken into segments for movement of the pieces representing said players;

f. spinner means for use by each player in turn to direct movement of the token of said player along said routes;

g. a first deck of cards having a distinctive label in which each card provides a reward to a player directed to pick a card from this deck;

h. a second deck of cards having a distinctive label in which each card penalizes a player directed to pick a card from this deck;

i. separate decks of cards labeled by the names of said motorcycle events so that each player upon landing on an event is entitled to remove a card labeled with that event, whereby the first player to return to his home city with a card from each motorcycle event is the declared winner of the game; and j. some of said segments on said routes being labeled to direct the player landing thereon to pick a card from either the first or second decks.

2. The game of claim 1 wherein said first and second decks are labeled LIFE and DEATH, respectively.

3. The game of claim 2 in which said tōken is in the form of a motorcycle.

* * * * *